US006241028B1

(12) United States Patent
Bijleveld et al.

(10) Patent No.: US 6,241,028 B1
(45) Date of Patent: Jun. 5, 2001

(54) METHOD AND SYSTEM FOR MEASURING DATA IN A FLUID TRANSPORTATION CONDUIT

(75) Inventors: Aarnoud F. Bijleveld; Steve J. Kimminau; Hans J. J. den Boer; John F. Stewart, all of Rijswijk (NL); Jerry Lee Morris, Houston, TX (US); Hagen Schempf, Pittsburgh, PA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/329,524

(22) Filed: Jun. 10, 1999

Related U.S. Application Data

(60) Provisional application No. 60/089,084, filed on Jun. 12, 1998.

(51) Int. Cl.[7] ..... E21B 23/00; E21B 47/00

(52) U.S. Cl. ..... 175/40

(58) Field of Search ..... 175/40, 44, 45, 175/46, 48, 50

(56) References Cited

U.S. PATENT DOCUMENTS

| | | | |
|---|---|---|---|
| 32,336 | 5/1861 | Luce . | |
| 3,086,167 | 4/1963 | Chaney et al. | 324/1 |
| 4,560,437 | 12/1985 | Kleppe et al. | 162/65 |
| 5,553,677 | 9/1996 | Hinz | 175/40 |

FOREIGN PATENT DOCUMENTS

| | | | |
|---|---|---|---|
| WO 93/18277 | 9/1993 | (WO) | E21B/23/00 |
| WO 97/17010 | 5/1997 | (WO) | A61B/1/12 |

*Primary Examiner*—Robert E. Pezzuto

(57) ABSTRACT

A method and system for measuring data in a fluid transportation conduit, such as a well for the production of oil and/or gas. The system employs one or more miniature sensing devices which comprise sensing equipment that is contained in a preferably spherical nut-shell which has an outer width which is smaller than the internal width of the conduit. One or more sensing devices are released sequentially in the conduit and are induced to move in longitudinal direction through the conduit to measure data at desired intervals of time, without requiring a complex infrastructure.

25 Claims, 5 Drawing Sheets

107
113
108
112
104

107
113
116
117
104
108
115

107
113
111
112
108
115
104

107
104
113
112
111
114
108
115
113
104
116

METHOD AND SYSTEM FOR MEASURING DATA IN A FLUID TRANSPORTATION CONDUIT

This application claims the benefit of U.S. Provisional Application No. 60/089,084, filed Jun. 12, 1998, the entire disclosure of which is hereby incorporated by reference.

FIELD OF THE INVENTION

The invention relates to a method and system for measuring data in a fluid transportation conduit and to a sensing device that forms part of such a system.

BACKGROUND TO THE INVENTION

If is often desirable to measure physical data, such as temperature, pressure and fluid velocity and/or composition in a fluid transportation conduit. However, it is not always feasible or economically attractive to provide the conduit with sensors which are able to measure such data along the length of the conduit over a prolonged period of time. In such circumstances so called intelligent pigs have been used to measure data, but since these pigs are pumped through the conduit they are large pieces of equipment which span the width of the conduit and therefore are not suitable to make in-situ measurements in the fluid flowing through the conduit. Also tethered sensor probes have been used to measure data in conduits, but these probes have a limited reach and involve complex and expensive reeling operations.

International patent application PCT/US97/17010 discloses an elongate autonomous robot which is released downhole in an oil and/or gas production well by means of a launching module that is connected to a power and control unit at the surface. The elongated robot is equipped with sensors and arms and/or wheels which allow the robot to walk, roll or crawl up and down through a lower region of the well. The insertion of the launching module into the well and the movement of the robot through the well is a complex operation and requires complex, fragile and expensive propulsion equipment.

U.S. Pat. No. Re. 32,336 discloses an elongate well logging instrument which is lowered into a borehole at the lower end of a drill pipe. When the pipe has reached a lower region of the borehole the logging tool is released, lowered to the bottom of a well and retrieved by means of an umbilical that extends through the drill pipe towards the wellhead.

U.S. Pat. No. 3,086,167 discloses a borehole logging tool which is dropped through a drill string to a location just above the drill bit to take measurements during drilling. The tool can be retrieved from the drill string by means of a fishing tool.

U.S. Pat. Nos. 4,560,437 and 5,553,677 and International patent application WO 93/18277 disclose other elongate downhole sensor assemblies that are removed from the well by means of a fishing tool or an umbilical.

It is an object of the present invention to provide a method and system for measuring data in a fluid transportation conduit over a prolonged period of time and which do not require permanently installed sensors, complex wireline tools and/or robotic transportation tools and which employ a sensing device which can be moved through the conduit without obstructing the conduit so that it is able to make in-situ measurements in the fluid within the conduit.

SUMMARY OF THE INVENTION

The method according to the invention comprises the steps of:

providing one or more sensing devices, each device comprising sensors for measuring physical data, a data processor for processing the measured data, and a protective shell containing the sensors and data processor, which shell has a smaller average outer width than the average internal width of a conduit from which measurements are to be made so that fluid in the conduit is permitted to flow around the sensing device;

inserting into the conduit the sensing device;

activating the sensors and data processor of at least one inserted sensing device to measure and process physical data in the conduit;

releasing at least one sensing device of which the sensors and data processor are or have been activated in the conduit;

allowing each released sensing device to move over a selected longitudinal distance through the conduit; and transferring the data processed by the data processor to a data collecting system outside the conduit.

The shell is both robust and compact so that the sensing device is able to travel over a long distance through the conduit and is small relative to the inner width of the conduit so that it does not obstruct the fluid flow through the conduit.

Preferably the sensing devices are not equipped with external mechanical propulsion means, such as propellers, wheels or robotic arms so that the sensor is very compact and is allowed to move freely and passively through the conduit under the influence of hydrodynamic forces induced by fluids flowing through the conduit, buoyancy, gravity and/or magnetic forces exerted to the sensing device.

The method according to the invention can be applied both in open fluid transportation conduits that are formed, for example, by a channel through which liquid flows, and in closed fluid transportation conduits where the conduit has a tubular shape. For example, open conduits could be streams or rivers, aqueducts, or sewers. For closed conduits it is preferred that each sensing device has a substantially globular protective shell and is released in a tubular conduit which has an average internal diameter which is at least 20% larger than the average external diameter of the spherical protective shell and the sensors and data processor form part of a micro electromechanical system (MEMS) with integrated sensory, navigation, power and data storage and/or data transmission components.

The method according to the invention is very attractive for use in downhole tubular conduits that form part of an underground oil and/or gas production well. In that case it is preferred that the sensing devices have a spherical protective shell with an outer diameter which is less than 15 cm and which are each induced to move along at least part of the length of the wellbore.

Suitably a plurality of sensing devices are stored at a downhole location near a toe of the well and released sequentially in the conduit, and each released sensing device is allowed to flow with the produced hydrocarbon fluids towards the wellhead. In such case it is preferred that the sensing devices are stored in a storage bin which is equipped with a telemetry-activated sensing device release mechanism and each sensing device comprises a spherical epoxy shell containing a thermistor-like temperature sensor, a piezo-silicon pressure sensor and a gyroscopic and/or multidirectional navigational accelerometer based position sensor, which sensors are powered off a chargeable battery or capacitor, and a data processor which is formed by an electronic random access memory (RAM) chip. Alternatively, or in addition to the navigational accelerometer, a sensor, for example, a sensor effective to detect casing couplings by a Hall effect sensor could be provided to track location by counting couplings. It is also preferred that each sensing device comprises a spherical plastic shell which is equipped with at least one circumferentially-wrapped electrically conductive wire loop which functions as an antenna loop for communications and as an inductive charger for the capacitor or battery and each sensing device is exposed to an electromagnetic field at least before it is released in the wellbore by the sensing device release mechanism, and wherein each released sensing device is retrieved at or near the earth surface and then linked to a data reading and collecting apparatus which removes data from the retrieved sensor device via a wireless method.

If the wellbore comprises a well tubular having a magnetizable, such as a steel, wall or contains a longitudinal magnetizable strip or wire then the sensing device may be equipped with magnetically-activated rolling locomotion components which induce the sensing device to retain rolling contact with the tubular or longitudinal strip or wire when the sensing device traverses the wellbore and the sensing device is equipped with a revolution counter and a sensor for detecting marker points in the well tubular, such as a casing junction and/or bar code marking points, to determine its position in the well tubular. In that case it is preferred that the magnetically-activated rolling locomotion components comprise a magnetic rotor which actively induces the sensing device to roll in a longitudinal direction through the well tubular if the well tubular has a substantially horizontal or an upwardly sloping direction.

The system according to the invention comprises

- at least one sensing device which comprises sensors for measuring physical data, a data processor for processing the measured data and a substantially globular protective shell containing the sensors and data processor, which shell has a smaller outer width than the average internal width of a conduit within which the physical data is to be measured so that fluid in the conduit is permitted to flow around the shell;
- power means for activating the sensors and data processor of each device to measure and process physical data in the conduit;
- a mechanism for sequentially releasing one or more sensing devices in the conduit; and
- a data collecting system located outside the conduit to which the data collected by the data processor of each released sensing device are transferred.

If the system is used in a conduit which forms part of an underground oil and/or gas production well it is preferred that a storage bin for downhole storage of a plurality of sensing devices, which bin is equipped with a telemetry activated sensing device release mechanism for sequentially releasing sensing devices in the conduit, a sensing device retrieval mechanism for retrieving released sensing devices at or near the earth surface and a data reading and processing apparatus which removes data from the retrieved sensing devices.

Alternatively, the sensors could be released in a torpedo shaped enclosure which is more dense than the conduit contents, and thus sinks to the lower portion of the conduit. At the lower end of the conduit, sensors could be released to be allowed to float back to the wellhead. When the conduit into which the torpedo is inserted is relatively level, or has relatively level sections, the torpedo shaped enclosures could be equipped with a propulsion system such as a propeller, or carbon dioxide jet to ensure that the enclosure reaches sufficiently far into the conduit.

A suitable sensing device for use in the system according to the invention comprises a spherical protective shell having an outer diameter less than 15 cm, which shell contains sensors for measuring physical data in the well and a data processor, which sensors and data processor form part of a micro electromechanical system (MEMS) with integrated sensory, navigation, power and data storage and/or data transmission components, and the shell further contains at least one circumferentially-wrapped electrically conductive wire loop which functions as a radio-frequency or inductive antenna loop for communications and as an inductive charger for the power components of the device.

DESCRIPTION OF A PREFERRED EMBODIMENT

Figures 1, 2:
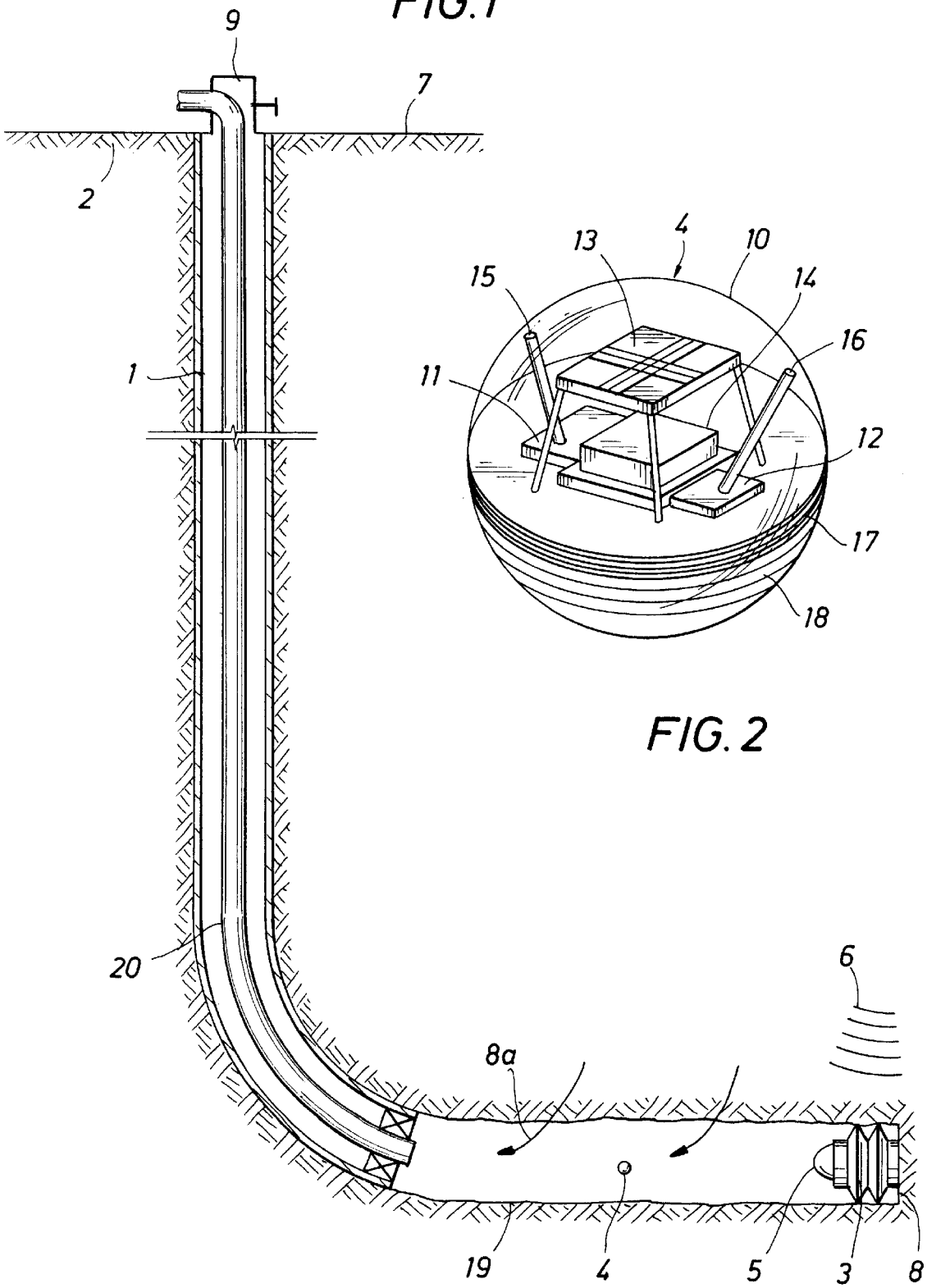
FIG. 1 shows an oil and/or gas production well which is equipped with a data measurement system according to the present invention in which sensing devices are released from a downhole storage container.
FIG. 2 shows an enlarged schematic three-dimensional view of a spherical sensing device for use in the system shown in FIG. 1.

Referring now to FIG. 1 there is shown an oil and/or gas production well 1 which traverses an underground formation 2 and which is equipped with a data measuring system according to the invention.

The data measuring system comprises a downhole storage container 3 in which a plurality of spherical sensing devices 4 are stored.

The storage container 3 is equipped with a sensing device release mechanism 5 which releases a sensing device 4 when it is actuated by means of a telemetry signal 6 transmitted by a wireless signal source (not shown), such as a seismic source, at the earth surface 7.

The storage container 3 is installed by means of a wireline (not shown) which pulls the container 3 to the toe 8 of the well 1 or by means of a downhole tractor or robotic device (not shown) which moves the container to the toe 8 of the well 1.

The container 3 is then releasably secured near the toe 8 of the well so that it can be replaced when it is empty or if maintenance or inspection would be required.

If a sensing device 4 is released from the container 3 by the release mechanism 5 the flow 8 of oil and/or gas will drag the device 4 through the well 1 towards the wellhead 9. The release mechanism may be activated by telemetry, or may be pre-programmed to release sensing device on a time schedule or under certain conditions.

As shown in FIG. 2 the sensing device 4 has an epoxy or other robust plastic spherical shell 10 which contains a micro electro-mechanical system (MEMS) comprising a miniaturized piezo-silicon pressure sensor 11, a bimetallic beam construct 12 for temperature measurements, multi-directional navigational accelerometers 13 and miniature conductive optical capacitive/opacity systems that are combined into a single silicon construct or personal computer (PC)board 14 or monolithic silicon crystal (custom-made).

A pressure port 15 in the shell 10 serves to provide open communication between the borehole fluids and the piezo-silicon pressure sensor 11 and a temperature port 16 in the shell 10 provides open communication between the borehole fluids and the bi-metallic beam construct 12 that serves as a temperature sensor.

The epoxy shell 10 is provided with circumferentially wrapped wire loops 17 encased in hard resin which function both as an antenna loop for wireless communications and as an inductive charger for the on-board high temperature battery or capacitor 18. Suitable high temperatures batteries are ceramic lithium ion batteries which are described in International patent application WO 97/10620.

Instead of or in addition to the navigational accelerometers 13 the sensing device 4 may also be equipped with hall-effect or micro-mechanical gyros to accurately measure the position of the sensing device 4 in the wellbore. The hall-effect sensors could count joints in a well casing in order to track distance.

When a sensing device 4 is released by the release mechanism 5 and travels through the well 1 the sensors 11, 12, 13 and 14 measure temperature, pressure and composition of the produced oil and/or gas or other wellbore fluids and the position of the sensing device 4 and transmit these data to a miniature random access memory (RAM) chip which forms part of the PC-board structure 14.

After the released sensing device 4 has traveled through the horizontal well inflow region 19 it flows together with the produced oil and/or gas into the production tubing 20 and then up to the wellhead 9. At or near the wellhead 9 or at nearby production facilities the sensing device 4 is retrieved by a sieve or an electromagnetic retrieving mechanism (not shown) and then the data stored in the RAM chip are downloaded by a wireless transmission method which uses the wire loops 17 as an antenna or inductive loop into a computer (not shown) in which the data are recorded, analyzed and/or further processed.

The sensing devices 4 have an outer diameter of a few centimeters only and therefore many hundreds of sensing devices 4 can be stored in the storage container 3.

By sequentially releasing a sensing device 4 into the produced well fluids, e.g. at time intervals of a few weeks or months, the system according to the invention is able to generate vast amounts of data over many years of the operating life of the well 1.

The system shown in FIGS. 1 and 2 requires a minimum of down-hole infrastructure and no downhole wiring so that it can be installed in any existing well.

If a well contains a downhole obstruction, such as a downhole pump, then a sensing device catcher is to be installed downhole, upstream of the obstruction, and the data stored in the sensing device are read by the catcher and transmitted to surface, whereupon the depleted sensing device is released again and may be crushed by the pump or other obstruction.

Figures 3, 4:
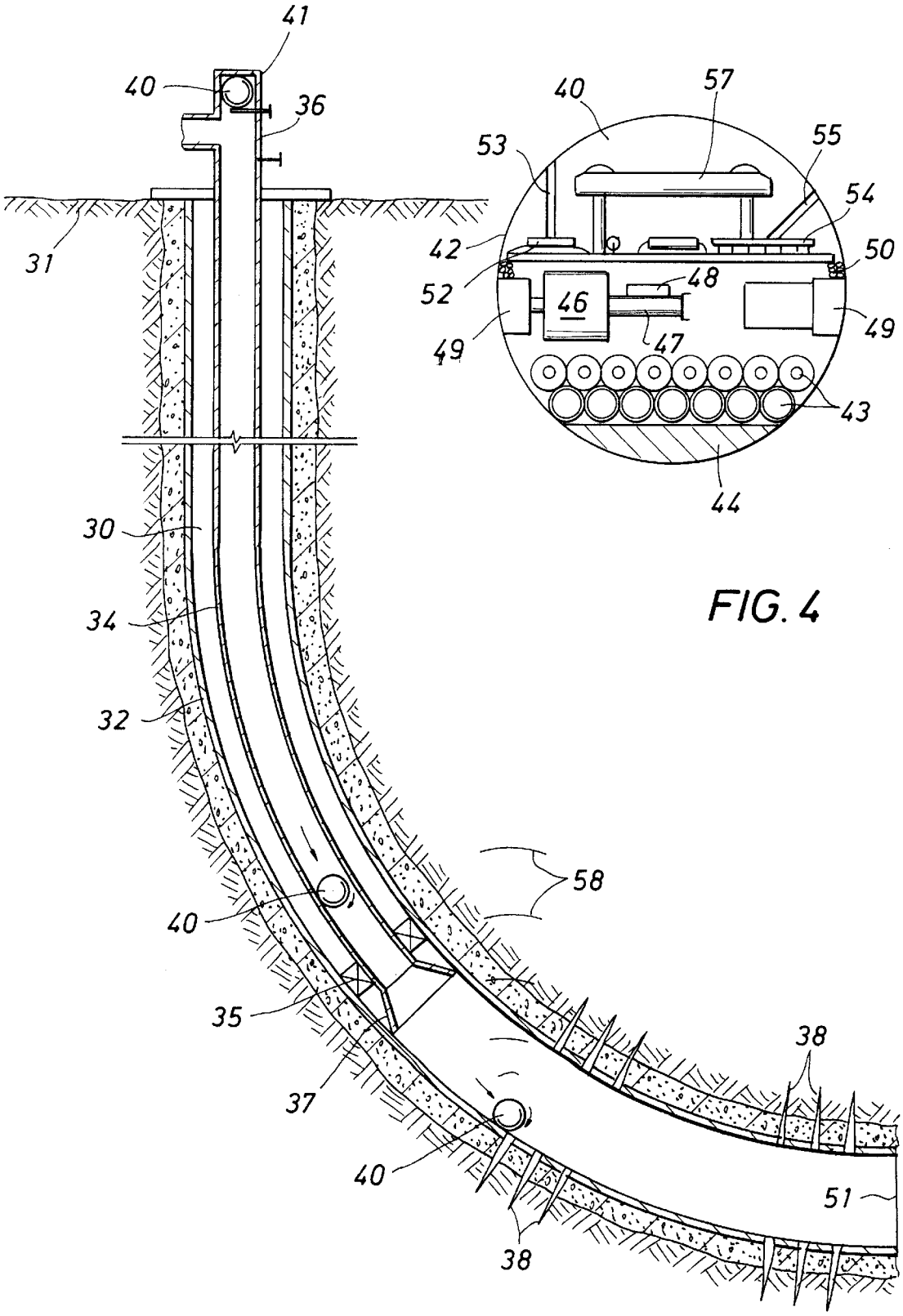
FIG. 3 shows an oil and/or gas production well which is equipped with an alternative data measurement system according to the present invention in which sensing devices are released at the wellhead and then roll into the well.
FIG. 4 shows a schematic enlarged three-dimensional view of a spherical sensing device for use in the system shown in FIG. 3.

Referring now to FIG. 3 there is shown an oil and/or gas production well 30 which traverses an underground formation 31.

The well 30 comprises a steel well casing 32 which is cemented in place by an annular body of cement 33 and a production tubing 34 which is at its lower end secured to the casing 32 by a production packer 35 and which extends up to the wellhead 36.

A frusto-conical steel guide funnel 37 is arranged at the lower end of the production tubing 34 and perforations 38 have been shot through the horizontal lower part of the casing 32 and cement annulus 33 into the surrounding oil and/or gas bearing formation 31 to facilitate inflow of oil and/or gas into the well 30.

Two sensing devices 40 are rolling in a downward direction through the production tubing 34 and casing 32 and a third sensing device is stored within a sensing device storage cage 41 at the wellhead 36.

As shown in FIG. 4 each sensing device has a spherical plastic shell 42 which houses sensing equipment and a series of chargeable batteries 43, a magnet 44, a drive motor 45, and electric motor 46 that drives a shaft 47 on which an eccentric weight 48 is placed, an inflatable rubber ring 49 and circumferentially wrapped wire loops 50 which serve both as an antenna loop for wireless communication and as an inductive charger for the batteries 43.

The magnet 44 and motor 45 which rotates the eccentric weight 48 form part of a magnetically-activated locomotion system which induces the sensing devices to roll along the inside of the steel production tubing 34 and casing 32 while remaining attached thereto. The navigation system of the sensing device may include a counter which counts the amount of revolutions made by the device to determine its position in the well 30.

The wellbore casing can function as a well tubular having a magnetizable wall or a longitudinal magnetizable strip or wire and when the sensing device is equipped with magnetically-activated rolling locomotion components, the casing can induce the sensing device to retain rolling contact with the tubular or longitudinal strip or wire when the sensing device traverses the wellbore. In this embodiment, the sensing device can be equipped with a revolution counter and a sensor for detecting marker points in the well tubular, such as a casing junction and/or bar code marking points, to determine its position in the well tubular.

A magnetically-activated rolling locomotion system can include a magnetic rotor which actively induces the sensing device to roll in a longitudinal direction through the well tubular if the well tubular has a substantially horizontal or an upwardly sloping direction.

In the horizontal inflow region of the well 30 the motor 46 will induce the eccentric weight 48 to rotate such that the sensing device 40 rolls towards the toe 51 of the well 30. After reaching the toe 51 the motor 47 is rotated in reverse direction so that the sensing device 40 rolls back towards the guide funnel 37 at the bottom of the substantially vertical production tubing 34.

The sensing device 40 then inflates the rubber ring 49 and floats up through the production tubing 34 and back into the storage cage 41 at the wellhead in which data recorded by the device 40 during its downhole mission are retrieved via the wire loops 50 and the batteries 43 are recharged.

Apart from the revolution counter the sensing equipment of the sensing device 40 shown in FIG. 4 is similar to the sensing equipment of the device 4 shown in FIG. 2. Thus, the device 40 comprises a MEMS which includes a pressure sensor 52 that is in contact with the well fluids via a pressure port 53, a temperature sensor 54 is in contact with the well fluids via a temperature port 55, navigational accelerometers 56 and miniature conductive optical capacitance/opacity systems that are combined into an internal personal computer (PC) board 57 which comprises a central processor unit (PCU) and random access memory (RAM) system to collect, process and/or store the measured data. Some or all data can be stored in the PCU-RAM system until the device 40 is retrieved at the storage cage 41 at the wellhead 36.

Alternatively some or all data can be transmitted via the wire loops 50 as electromagnetic waves 58 towards a receiver system (not shown) which is either located at the earth surface or embedded downhole in the well 30. The latter system provides a real-time data recording and is attractive if the sensing device 40 is also equipped with an on-board camera so that a very detailed inspection of the well 30 is possible throughout many years of its operating life.

The spherical shell 42 of the sensing device 40 shown in FIGS. 3 and 4 has an outer diameter which is preferably between 5 and 15 cm, preferably between 9 and 11 cm, which is larger than the diameter of the shell 10 of the sensing device 4 shown in FIGS. 1 and 2.

However, the outer diameter of the sensing device 40 is still at least 20% smaller than the internal diameter of the production tubing 34 so that well fluids can fully flow around the spherical shell 42 of the device 40 and the device 40 does not obstruct the flux of well fluids so that the device 40 is able to collect realistic production data downhole.

If desired the same sensing device 40 may be released sequentially into the well 32 to gather production data, so that the data measurement system requires a minimal amount of equipment.

Figure 5:
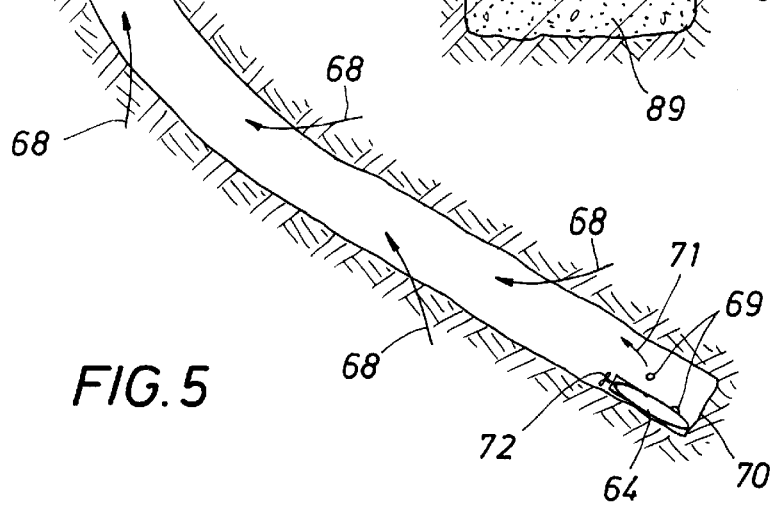
FIG. 5 is a schematic longitudinal sectional view of a well in which sensing devices are released from a melting torpedo-shaped carrier tool.

Referring now to FIG. 5 there is shown a well 60 which penetrates an underground formation 61. The well 60 has a wellhead 62 which is equipped with a launch pipe 63 via which a torpedo-shaped sensor device carrier tool 64 can be launched into the well 60.

The launch pipe 63 is equipped with an upper valve 65 and a lower valve 66. When the carrier tool 64 is inserted into the launch pipe 63 the upper valve 65 is open and the lower valve 66 is closed. Then the upper valve 64 is closed and the lower valve 65 is opened which allows the carrier tool 64 to drop into the well 60. The well 60 shown in FIG. 5 is J-shaped and is equipped with a vertical production tubing 67 in the upper part of the well 60. The lower part of the well 60 is inclined and forms the inflow zone through which oil and/or gas flow into the wellbore as indicated by arrows 68.

When the conduit is an open conduit the sensor could be inserted and released by, for example, manually dropping the sensor into the conduit.

The two carrier tools 64 that are present in the well 60 are made of a wax body in which two or more globular sensing devices 69 are embedded. The wax body may be ballasted by lead particles to provide the tools 64 with a higher density than the oil and/or gas produced in the well 60, so that the carrier tools 64 will descend to the bottom 70 of the well 60.

Alternatively, or in addition to ballast, the carrier could be motivated by a propulsion system such as, for example, a motor driven propeller or a jet of higher pressure gas 72. The motor driven propeller could be utilized to carry the sensing device into highly deviated wells, where gravity-driven deployment may not be effective.

The composition of the wax is such that it will slowly melt at the temperature at the bottom 70 of the well 60. After the wax body of the carrier tool 64 at the bottom 70 has at least been partly melted away the tool 64 disintegrates and the sensing devices 69 are released into the well as illustrated by arrow 71.

Each sensing device 69 has a lower density than the oil and/or gas in the well 60 so that the device 69 will flow up towards the wellhead 62.

The sensing devices may be equipped with a MEMS and navigational accelerometers and temperature and pressure sensors which are similar to those shown in and described with reference to FIG. 2. The data may be recorded by the sensing device 69 in the same way as described with reference to FIG. 2 and may be retrieved by a reading device after the sensing device 69 has been removed from the well fluids by a catcher at or near the wellhead 62.

The sensors of the sensing device 69 may already be activated when the carrier device 64 is dropped into the well 60 via the launch pipe 63. To allow the pressure and temperature sensors to make accurate measurements during the descent of the carrier device 64 into the well openings (not shown) must be present in the wax body of the device 64 which provide fluid communication between the pressure and temperature sensors and the well fluids. The two sensing devices 69 carried by the carrier tool 69 into the well 60 may contain different sensors.

One sensing device 69 may be equipped with pressure and temperature sensors whereas the other sensing device 69 may be equipped with a camera and videorecorder to inspect the well and with a sonar system which is able to detect the inner diameter of the well tubulars and/or the existence of corrosion and/or erosion of these tubulars and the presence of any deposits such as wax or scale within the well tubulars.

The sensing devices 69 may also be equipped with acoustic sensors which are able to detect seismic signals produced by a seismic source which is located at the earth surface or downhole in a nearby well. In this way the sensing devices 69 are able to gather seismic data which provide more accurate information about the underground oil and/or gas bearing strata than seismic recorders that are located at the earth surface. The acoustic sensors may collect seismic data both when the sensing device 69 descends and floats up through the well 60 and when the device 69 is positioned at a stationary position near the well bottom 70 before the waxy torpedo-shaped body of the carrier tool 64 has melted away.

Thus the sensors of the sensing device 69 may collect data not only when the device 69 moves through the well 60 but also when the device is located at a stationary position in the well 60. Furthermore, the protective shell of the sensing devices 69 may have a globular, elliptical, tear drop or any other suitable shape which allows the well fluids to flow around the sensing device 69 when the device 69 moves through the wellbore.

Figure 6:
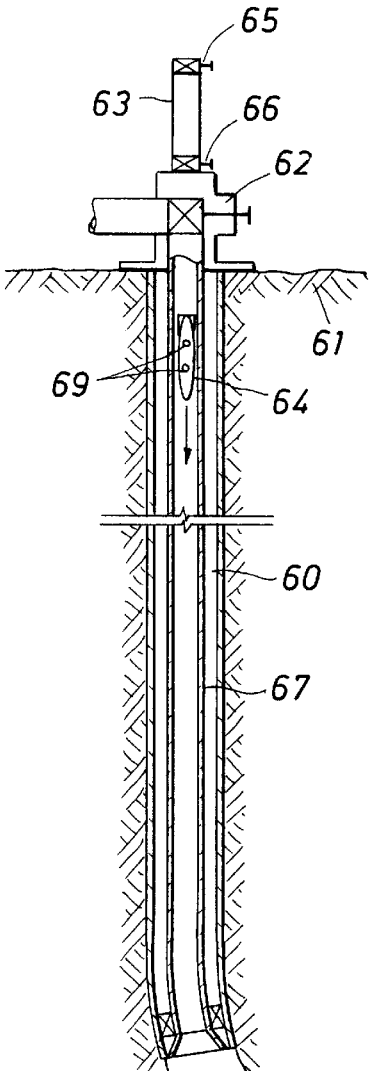
FIG. 6 is a schematic longitudinal section view of a well including a processor which is not located within the well.
Figure 6:
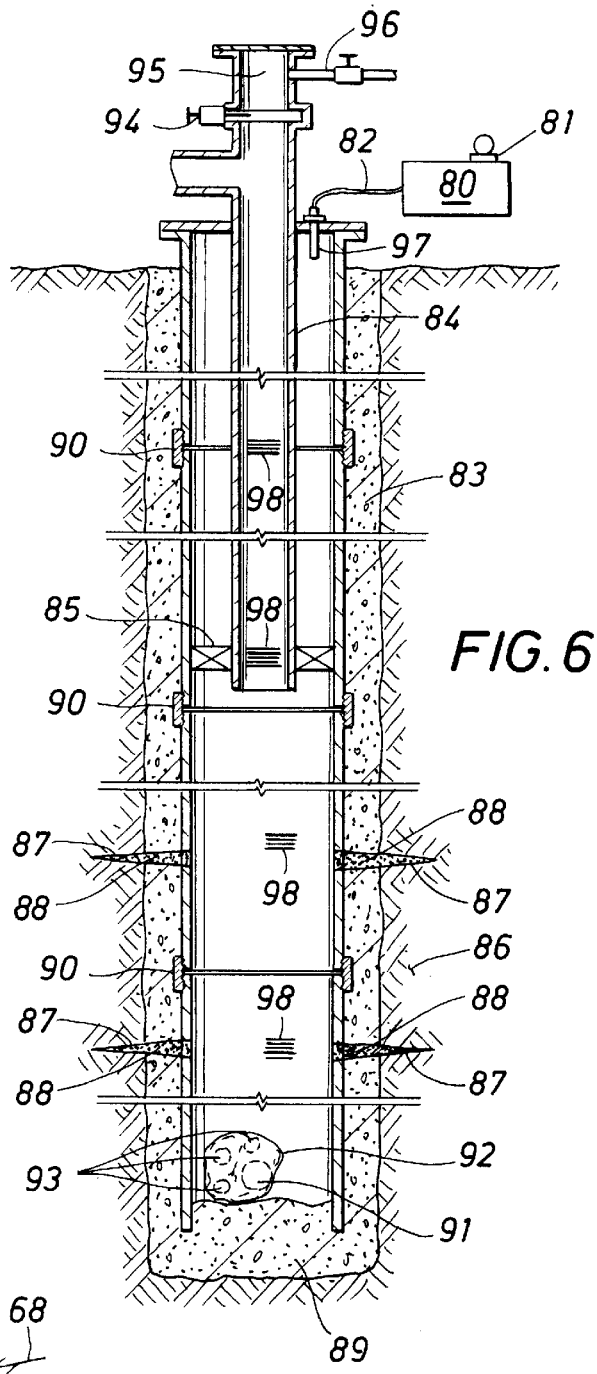

Referring now to FIG. 6, an alternative arrangement of the system of the present invention is shown. A processor 80 located outside of a well 83 is shown. A docket sensor 81 is shown, the docked sensor having been recovered from the fluids flowing from the well. The processor is also provided with a cable 82 providing communication to an antenna 97 for telemetric communication with the sensors within the wellbore. The well is provided with a production tubing 84 extending to below a packer 85 and extends into a 86 which is in fluid communication with the inside of the well through perforations 87, the perforations packed with permeable sand 88, and the perforations extending through cement 89 that supports the well within the wellbore. The casing includes joints 90 which can be counted by the hall effect detectors in a sensor as the sensor rises through the well. Alternatively to the hall effect detectors, or in addition to the hall effect detectors, the casing and/or the production tubular could include bar codes 98 which could be read by the sensor as it rises through the well to identify which segment the data from the sensor was taken in. A ballasted sensor 91 is shown in a meltable wax ball 92 weighted by lead pellets 93. The weighted sensor can be placed in the well through a gate valve 94 which can isolate a holding volume 95 from the flowpath of the production tubing, and can be forced out of the holding volume by compressed gas through a line 96. After a sufficient amount of wax has melted, the sensor will be detached from the ballast, and rise through the well. Hall effect detectors will count the couplings passed, and either transmit data, including the passing of the couplings, to the processor outside of the well by telemetry through the antenna 83. Alternatively, the processor may be equipped with a connection for reading stored data from the sensor after the sensor is removed from the produced fluids.

Figure 7:
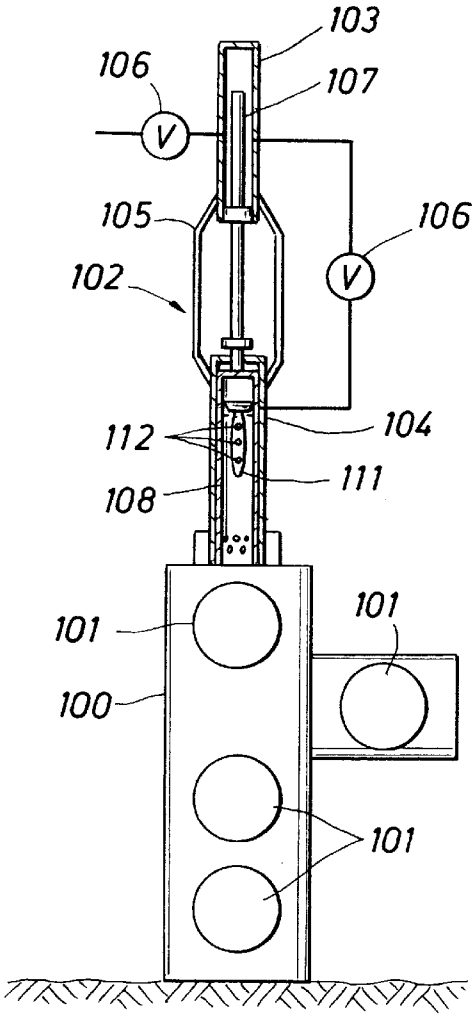
FIG. 7 schematically shows a wellhead which is equipped with a torpedo launch module.

FIG. 7 shows a wellhead which included an X-mas tree 100 which is equipped with a number of valves 101 and a torpedo launch module 102.

Figure 8:
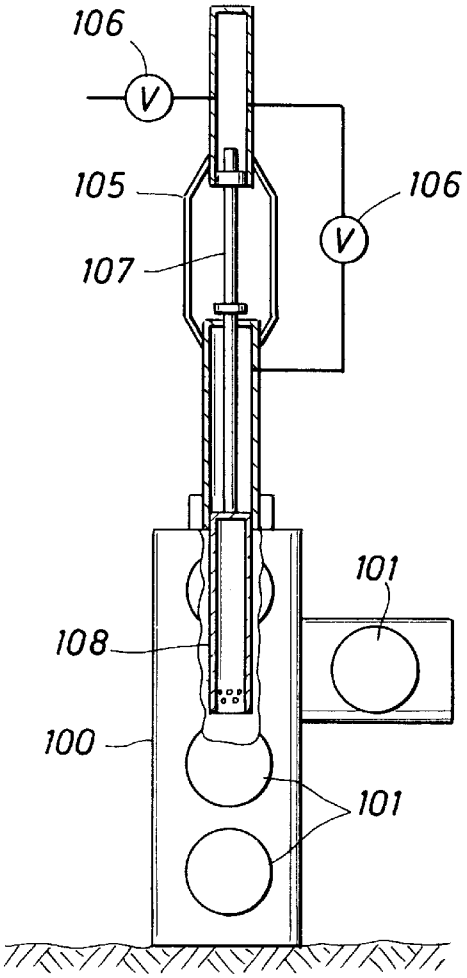
FIG. 8 shows the launch module of FIG. 7 after the torpedo has been launched.

The launch module 102 has upper and lower pressure containing chambers 103 and 104 connected by a structural member or yolk 105 holding both together. This structural member 105 has internal drillings which communicate pressure between the chambers. By manipulating valves 106 in the system, pressure can be increased, decreased or isolated in the upper chamber 103. A polished rod 107 straddles the gap between the two chambers passing through a pressure containing seal mechanism in each chamber. This rod 107 is free to move up and down within both chambers 103 and 104 and is connected to a releasing/catching flow sleeve 108 housed in the lower pressure chamber. This sleeve is inserted into the X-mas tree bore by equalising the pressures in the upper and lower chambers through the pre-drilled pressure equalising system. When pressures in both chambers 103 and 104 are equalised the rod 107 with the sleeve 108 attached can be lowered into the tree bore as is shown in FIG. 8.

Figures 9, 10, 11, 12:
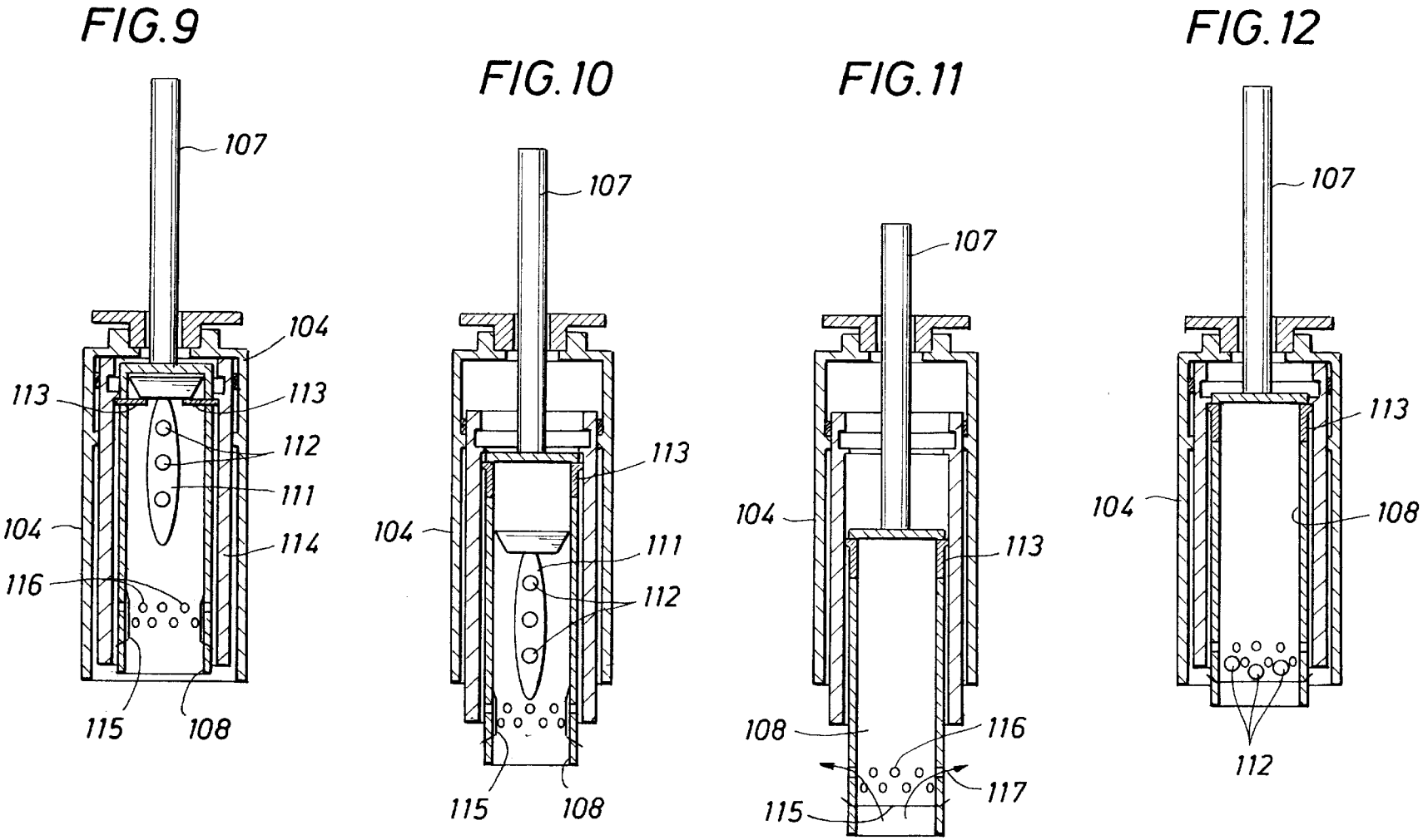
FIGS. 9 and 10 show in more detail the lower part of the torpedo launch module during the torpedo launch procedure.
FIG. 11 shows the launch module during oil and/or gas production operations while sensor catching fingers are deployed.
FIG. 12 shows the flow sleeve in a retracted position thereof, after three sensors have been recovered.

FIG. 9 shows the lower chamber 103 while the flow sleeve is in the retracted position thereof and a wax torpedo 110 in which three spherical sensors 111 are embedded is held in place by a series of locking arms 113. The locking arms 113 are pivotally connected to an intermediate sleeve 114 such that when the flow sleeve 108 is pushed down by the polished rod 107 the locking arms 113 pivot away from the tail of the torpedo 111 and the torpedo is released into the well, as is shown in FIG. 10.

FIG. 11 shows the flow sleeve 108 in its fully extended position in which a series of sensor catching fingers 115 extend into the flow sleeve. The fingers 115 will allow sensors 112 that flow up with the well fluids after dissolution of the waxy torpedo to enter into the flow sleeve 108, but prevent the sensors 112 to fall back into the well.

The flow sleeve 108 is provided with a series of orifices 116 which are smaller than the sensors 112.

When the flow sleeve 108 is fully lowered into the tree bore it straddles the outlet to the flowline and well flow is directed through the orifices 116 in the flow sleeve 108 as illustrated by arrows 117. When the sensors 112 return to the surface, carried by the well flow they are caught in the flow sleeve 108 and retained by the catching fingers 115. A detector in the sleeve 108 indicates when the sensors 112 are located in the catcher and can be recovered. To recover the sleeve 108, the valve 106 allowing pressure communication between the upper and lower pressure chambers 103 and 104 is closed. Pressure is bled off from the top pressure chamber 103. The rod 107 attached to the sleeve 108 is pushed into the upper chamber 103 due to the differential pressure between the lower and upper chambers, this in turn retracts the sleeve 108 containing the recovered sensors 112 from the X-mas tree bore as is illustrated in FIG. 12.

What is claimed is:

1. A method for measuring data in a fluid transportation conduit, the method comprising the steps of:

providing one or more sensing devices, the sensing devices each comprising sensors for measuring physical data, a data processor for processing the measured data, and a protective shell containing the sensors and data processor, which shell has a smaller average outer width than the average internal width of the conduit so that fluid in the conduit is permitted to flow around the sensing device;

inserting into the conduit the one or more sensing devices;

activating the sensors and data processor of at least one inserted sensing device to measure and process physical data in the conduit;

releasing at least one sensing device of which the sensors and data processor are or have been activated in the conduit;

allowing each released sensing device to move over a selected longitudinal distance through the conduit; and transferring the data processed by the data processor to a data collecting system outside the conduit.

2. The method of claim 1, wherein each released sensing device is allowed to move freely through the conduit under the influence of hydrodynamic forces induced by a means selected from the group consisting of the fluid flowing through the conduit, buoyancy, gravity and magnetic forces.

3. The method of claim 1, wherein each sensing device has a substantially globular protective shell and is released in a tubular conduit which has an average internal diameter which is at least 20% larger than the average external diameter of the spherical protective shell and the sensors and data processor form part of a micro electromechanical system with a component selected from the group consisting of integrated sensory, navigation, power and data storage and data transmission components.

4. The method of claim 3, wherein the tubular conduit forms part of an underground hydrocarbon fluid production wellbore and sensing devices having a spherical protective shell with an outer diameter which is less than 15 cm are released sequentially in the conduit and are each induced to move along at least part of the length of the wellbore.

5. The method of claim 4, wherein a plurality of sensing devices are stored at a downhole location near a toe of the well and released sequentially in the conduit, and each released sensing device is allowed to flow with the produced hydrocarbon fluids towards the wellhead.

6. The method of claim 5, wherein the sensing devices are stored in a storage bin which is equipped with a telemetry-activated sensing device release mechanism and each sensing device comprises a spherical epoxy shell containing a sensor selected from the group consisting of thermistor-like temperature sensor, a piezo-silicon pressure sensor and a gyroscopic and multidirectional navigational accelerometer based position sensor, which sensors are powered off a chargeable battery or capacitor, and a data processor which is formed by an electronic random access memory chip.

7. The method of claim 6, wherein each sensing device comprises a spherical plastic shell which is equipped with at least one circumferentially-wrapped electrically conductive wire loop which functions as a radio-frequency or inductive antenna loop for communications and as an inductive charger for the capacitor or battery and each sensing device is exposed to an electromagnetic field at least before it is released in the wellbore by the sensing device release mechanism, and wherein each released sensing device is retrieved at or near the earth surface and then linked to a data reading and processing apparatus which removes data from the retrieved sensor device via a wireless method.

8. The method of claim 4, wherein the wellbore comprises a magnetizable element selected from the group consisting of a well tubular having a magnetizable wall and a longitudinal magnetizable strip or wire, and the sensing device is equipped with magnetically-activated rolling locomotion components which induce the sensing device to retain rolling contact with the magnetizable element when the sensing device moves over the selected longitudinal distance thorough the wellbore by the activated rolling locomotion components.

9. The method of claim 8, wherein the sensor further comprises a revolution counter which tracks distance moved and a sensor for detecting marker points in the wellbore.

10. The method of claim 9, wherein the marker points in the well are selected from the group consisting of a casing junction and bar code marking points.

11. The method of claim 8, wherein the magnetically-activated rolling locomotion components comprise a magnetic rotor which actively induces the sensing device to roll in a longitudinal direction through the well tubular if the well tubular has a substantially horizontal or an upwardly sloping direction.

12. The method of claim 1, wherein the sensing device is provided in a carrier that is released into the conduit at a first point of the conduit, and moves through a portion of the conduit, where the sensor is released from the carrier, and then the sensor moves back to the first point in the conduit.

13. The method of claim 12, wherein the carrier is a ballasted carrier, and the carrier is moved by gravity to a low point in the conduit.

14. The method of claim 12, wherein the carrier is motivated by a propulsion system.

15. The method of claim 13, wherein the carrier is made of a material that dissolves or melts in the conduit fluids at the conduit temperatures.

16. The method of claim 1, wherein the fluid transportation conduit is a pipeline.

17. The method of claim 1, wherein the fluid transportation conduit is a tubular or an open sewer conduit.

18. The method of claim 1, wherein the sensor for measuring physical data includes a video camera.

19. The method of claim 1, wherein the sensor for measuring physical data includes an acoustic sensor.

20. A system for measuring data in a fluid transportation conduit, the system comprising:

at least one sensing device, the sensing device comprising sensors for measuring physical data, a data processor for processing the measured data and a substantially globular protective shell containing the sensors and data processor, which shell has a smaller outer width than the average internal width of the conduit so that fluid in the conduit is permitted to flow around the shell;

power means for activating the sensors and data processor of each device to measure and process physical data in the conduit;

a releasing mechanism for sequentially releasing one or more sensing devices in the conduit; and a data collecting system located outside the conduit to which the data collected by the data processor of each released sensing device are transferred.

21. The system of claim 20, wherein the conduit forms part of an underground hydrocarbon production well and the system comprises a storage bin for downhole storage of a plurality of sensing devices, which bin is equipped with a telemetry activated sensing device release mechanism for sequentially releasing sensing devices in the conduit, a sensing device retrieval mechanism for retrieving released sensing devices at or near the earth surface and a data reading and collecting apparatus which removes data from the retrieved sensing devices.

22. The system of claim 20, wherein the fluid transportation conduit is a pipeline.

23. A sensing device comprising:

a spherical protective shell having an outer diameter less than 15 cm, which shell contains sensors for measuring physical data in the well and a data processor, which sensors and data processor form part of a micro electromechanical system with integrated sensory;

a navigation component;

a power component;

a component selected from the group of a data storage component and a data transmission component; and at least one circumferentially-wrapped electrically conductive wire loop which functions as a radio-frequency or inductive antenna loop for communications and as an inductive charger for the power components of the device.

24. The sensor of claim 23 further comprising a video camera.

25. The sensor of claim 23 further comprising an acoustic sensor.

* * * * *